US012264847B2

(12) United States Patent
Tamaki

(10) Patent No.: US 12,264,847 B2
(45) Date of Patent: Apr. 1, 2025

(54) MULTI-SPLIT TYPE AIR-CONDITIONING DEVICE AND CONNECTION DETERMINATION METHOD

(71) Applicant: Mitsubishi Electric Corporation, Tokyo (JP)

(72) Inventor: Shogo Tamaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 23 days.

(21) Appl. No.: 18/251,168

(22) PCT Filed: Mar. 10, 2021

(86) PCT No.: PCT/JP2021/009414
§ 371 (c)(1),
(2) Date: Apr. 28, 2023

(87) PCT Pub. No.: WO2022/190229
PCT Pub. Date: Sep. 15, 2022

(65) Prior Publication Data
US 2024/0328671 A1 Oct. 3, 2024

(51) Int. Cl.
*F24H 15/10* (2022.01)
*F24F 11/50* (2018.01)
(Continued)

(52) U.S. Cl.
CPC ..... *F24H 15/10* (2022.01); *F24F 11/50* (2018.01); *F24F 11/65* (2018.01); *F24H 15/238* (2022.01)

(58) Field of Classification Search
CPC .. F24D 11/0214; F24D 17/02; F24D 19/1072; F24F 11/49; F24F 11/50;
(Continued)

(56) References Cited

U.S. PATENT DOCUMENTS

2017/0219255 A1* 8/2017 Hu ..... F25B 49/022
2018/0347846 A1* 12/2018 Tamaki ..... F24D 11/0235
2019/0360731 A1* 11/2019 Dixit ..... F24F 11/84

FOREIGN PATENT DOCUMENTS

CN 110726211 B * 11/2020
JP 2007-218512 A 8/2007

OTHER PUBLICATIONS

International Search Report of the International Searching Authority mailed Apr. 27, 2021 in corresponding International Application No. PCT/JP2021/009414 (and English translation attached).

* cited by examiner

*Primary Examiner* — Kidest Bahta
(74) *Attorney, Agent, or Firm* — Posz Law Group, PLC

(57) ABSTRACT

A multi-split type air-conditioning device includes an indoor hot water unit, an indoor air unit, and an outdoor unit to which the indoor hot water unit and the indoor air unit are connected. The outdoor unit includes an outdoor unit-control unit configured to control a refrigerant circuit and transmits control commands for the indoor hot water unit and the indoor air unit via transmission signal lines. The outdoor unit-control unit executes an indoor hot water unit-determination process of causing the refrigerant circuit to perform a heating operation, and determining the branch port to which the indoor hot water unit is connected and an indoor air unit-determination process of causing the refrigerant circuit to perform a cooling operation, and determining a connection relationship between the branch port to which the indoor air unit is connected and the indoor air unit.

12 Claims, 4 Drawing Sheets

(51) Int. Cl.
*F24F 11/65* (2018.01)
*F24H 15/238* (2022.01)

(58) Field of Classification Search
CPC .. F24F 11/65; F24F 11/77; F24F 11/84; F24F 2140/20; F24F 2221/54; F24F 5/0096; F24H 15/10; F24H 15/104; F24H 15/215; F24H 15/219; F24H 15/223; F24H 15/238; F24H 15/242; F24H 15/281; F24H 15/32; F24H 15/35; F24H 15/395; F24H 15/429; F24H 15/443; F24H 15/464
See application file for complete search history.

FIG. 3
| INDOOR UNIT | CONNECTION DESTINATION INFORMATION | |
|---|---|---|
| | BRANCH PORT ID | WIRING PORT ID |
| INDOOR HOT WATER UNIT | B03 | L03 |
| INDOOR AIR UNIT A | B01 | L01 |
| INDOOR AIR UNIT B | B02 | L02 |
FIG. 4
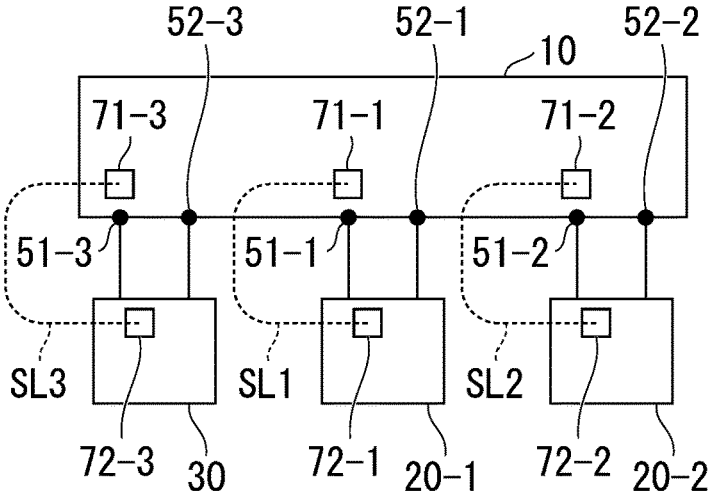
FIG. 5
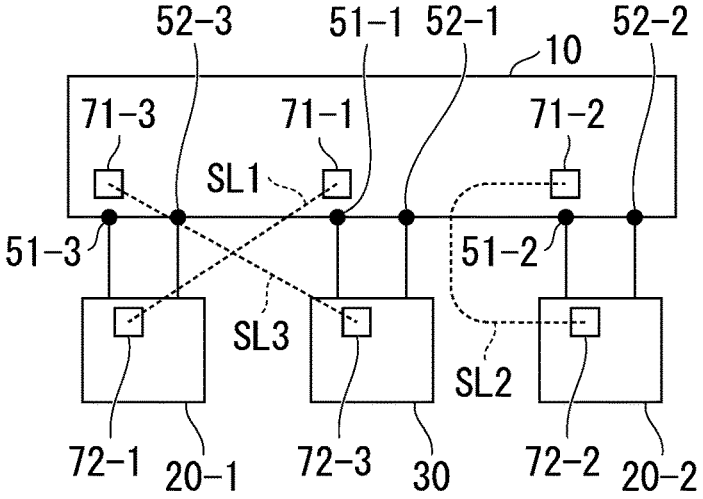

MULTI-SPLIT TYPE AIR-CONDITIONING DEVICE AND CONNECTION DETERMINATION METHOD

CROSS REFERENCE TO RELATED APPLICATION

This application is a U.S. national stage application of International Application No. PCT/JP2021/009414, filed on Mar. 10, 2021, the contents of which are incorporated herein by reference.

TECHNICAL FIELD

The present disclosure relates to a multi-split type air-conditioning device and a connection determination method.

BACKGROUND

In a multi-split type air-conditioning device in which a plurality of indoor units are connected to one outdoor unit through pipes, a connection of a refrigerant pipe and a connection of transmission signal line are usually performed manually by an operator during the installation work on site. Because the connection of the refrigerant pipe and the connection of the transmission signal line are performed individually, an installation error in which corresponding relationships regarding the refrigerant pipe and the transmission signal line are formed in inconsistent connections (mismatch connections) may occur. Technology for determining the inconsistency in the corresponding relationships regarding the refrigerant pipe and the transmission signal line is known (see, for example, Patent Document 1).

PATENT DOCUMENT

[Patent Document 1]

Japanese Unexamined Patent Application, First Publication No. 2007-218512

However, a multi-split type air-conditioning device described in Patent Document 1 described above is applicable in a case where a type of indoor unit is a single indoor unit including an air heat exchanger (hereinafter referred to as an indoor air unit). That is, in the multi-split type air-conditioning device described in Patent Document 1, when an indirect air-conditioning indoor unit for performing an air conditioning process indoors via a water medium (hereinafter referred to as an indoor hot water unit) is included, it is difficult to appropriately determine a connection between an outdoor unit and an indoor unit.

Also, many indirect air-conditioning indoor units that can only generate hot water and cannot generate cold water are known. On the other hand, when the outdoor unit is in a heating operation, a pressure reduction mechanism of a stopped indoor unit must be slightly open to avoid refrigerant retention in the stopped indoor unit. However, because there is no refrigerant retention in the stopped indoor unit in the cooling operation and an opening degree of the pressure reduction mechanism can be fully closed, it is easier to more accurately determine a corresponding relationship during the cooling operation than during the heating operation. Therefore, it is desirable for the corresponding relationship determination to be made in the cooling operation when possible. However, there is a problem that the corresponding relationship determination in the cooling operation is difficult when there is an indirect air-conditioning indoor unit in which only the heating operation can be performed.

SUMMARY

The present disclosure is made to solve the above problems and an objective thereof is to provide a multi-split type air-conditioning device and a connection determination method capable of appropriately determining a connection between an outdoor unit and an indoor unit even if both an indoor hot water unit and an indoor air unit are included.

According to an aspect of the present disclosure for solving the above-described problem, there is provided a multi-split type air-conditioning device including an indoor hot water unit including a water circuit in which a water medium circulates as a heat exchange medium, an indoor air unit including an air heat exchanger, and an outdoor unit to which the indoor hot water unit and the indoor air unit are connected, wherein the outdoor unit includes: branch ports beside which pressure reduction mechanisms are disposed after a branch of a refrigerant circuit and to which the indoor air unit and the indoor hot water unit are connected through pipes; and an outdoor unit-control unit configured to control the refrigerant circuit and transmit control commands for the indoor hot water unit and the indoor air unit via transmission signal lines, and wherein the outdoor unit-control unit executes an indoor hot water unit-determination process of causing the refrigerant circuit to perform a heating operation, and determining the branch port to which the indoor hot water unit is connected and, an indoor air unit-determination process of causing the refrigerant circuit to perform a cooling operation, and determining a connection relationship between the branch port to which the indoor air unit is connected and the indoor air unit.

According to an aspect of the present disclosure, there is provided a connection determination method of determining a connection of an indoor unit in a multi-split type air-conditioning device including an indoor hot water unit including a water circuit in which a water medium circulates as a heat exchange medium, a plurality of indoor air units each including an air heat exchanger, and an outdoor unit to which the indoor hot water unit and the plurality of indoor air units are connected, wherein the outdoor unit includes: branch ports beside which pressure reduction mechanisms are disposed after a branch of a refrigerant circuit and to which the plurality of indoor air units and the indoor hot water unit are connected through pipes; and an outdoor unit-control unit configured to control the refrigerant circuit and transmit control commands for the indoor hot water unit and the plurality of indoor air units via transmission signal lines, wherein the outdoor unit-control unit executes an indoor hot water unit-determination process of causing the refrigerant circuit to perform a heating operation, causing a refrigerant to flow through the branch ports sequentially using the pressure reduction mechanisms, and determining the branch port to which the indoor hot water unit is connected, and wherein, after the indoor hot water unit-determination process is executed, the outdoor unit-control unit executes an indoor air unit-determination process of causing the refrigerant circuit to perform a cooling operation, causing a refrigerant to flow through the branch ports to which the indoor hot water unit is not connected, and determining a connection relationship between the branch ports to which the plurality of indoor air units are connected and the plurality of indoor air units.

According to the present disclosure, it is possible to appropriately determine a connection between an outdoor unit and an indoor unit even if both an indoor hot water unit and an indoor air unit are included.

BRIEF DESCRIPTION OF DRAWINGS

FIG. 3 is a diagram showing an example of data of an outdoor storage unit in the embodiment.

FIG. 4 is a first diagram showing an example of a connection of a refrigerant pipe and a connection of a transmission signal line of the multi-split type air-conditioning device according to the embodiment.

FIG. 5 is a second diagram showing an example of a connection of the refrigerant pipe and the connection of the transmission signal line of the multi-split type air-conditioning device according to the embodiment.

DETAILED DESCRIPTION

Hereinafter, a multi-split type air-conditioning device and a connection determination method according to an embodiment of the present disclosure are described with reference to the drawings.

Figure 1:
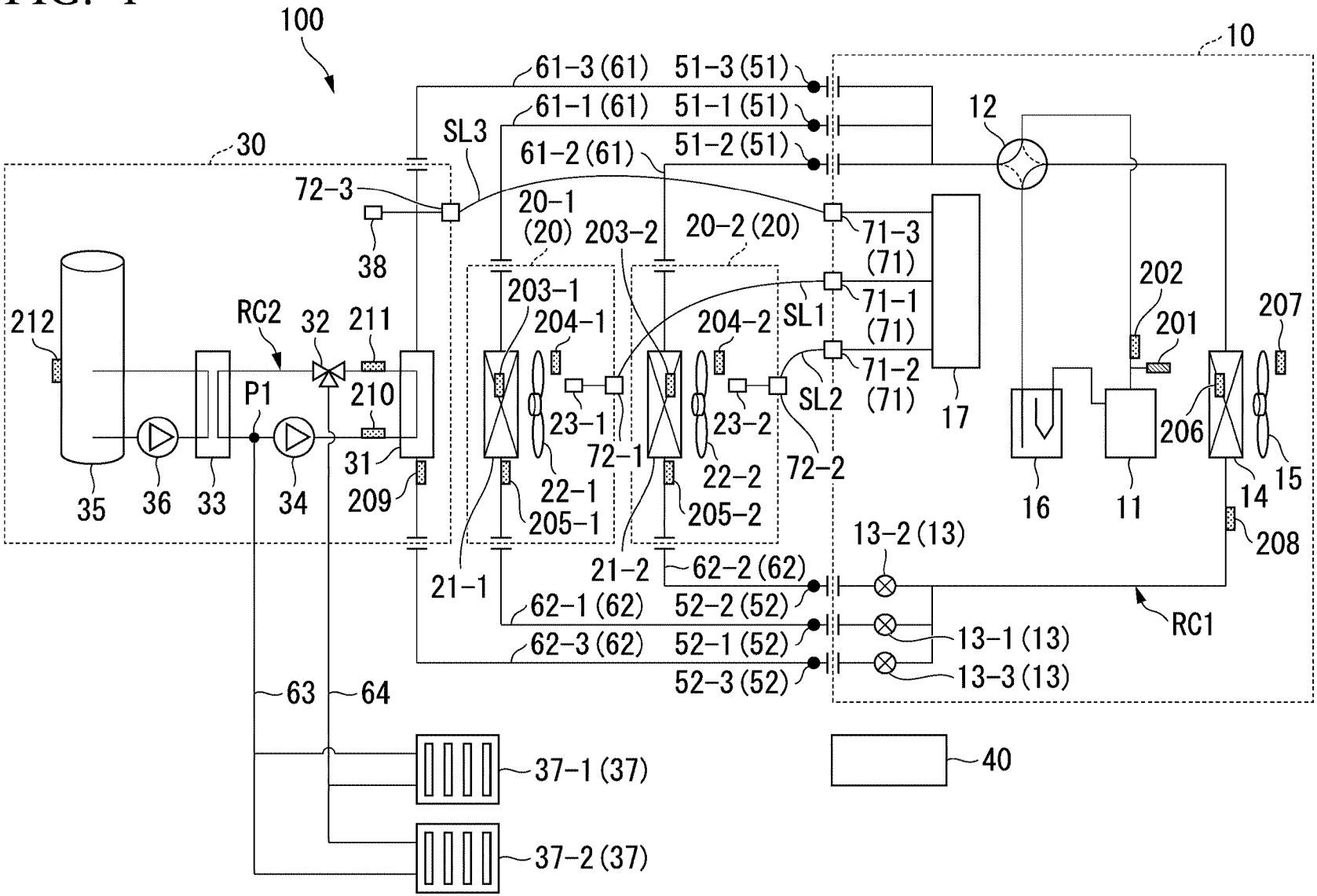
FIG. 1 is a configuration diagram showing an example of a multi-split type air-conditioning device according to an embodiment.

FIG. 1 is a configuration diagram showing an example of a multi-split type air-conditioning device 100 according to the present embodiment.

As shown in FIG. 1, the multi-split type air-conditioning device 100 includes an outdoor unit 10, a plurality of indoor air units 20, an indoor hot water unit 30, and an external controller 40. Also, in the present embodiment, an example in which two indoor air units 20 (an indoor air unit 20-1 and an indoor air unit 20-2) are provided is described.

Also, in the present embodiment, the indoor air unit 20-1 and the indoor air unit 20-2 have the same configuration and are described as indoor air units 20 when any indoor air units provided in the multi-split type air-conditioning device 100 are indicated or when they are not particularly distinguished.

The multi-split type air-conditioning device 100 is disposed at a building such as, for example, a general home, and executes a cooling operation and a heating operation by switching an operation therebetween with the indoor air unit 20-1 and the indoor air unit 20-2. Also, the multi-split type air-conditioning device 100 executes a hot water heating operation and a hot water supply operation with the indoor hot water unit 30.

The outdoor unit 10 is a heat source unit disposed outside of a building (outdoors) and configured to generate heat that is supplied to the outdoor unit. An indoor hot water unit 30 and a plurality of (for example, two) indoor air units 20 are connected to the outdoor unit 10. The outdoor unit 10 includes a compressor 11, a four-way valve 12, pressure reduction mechanisms 13 (13-1, 13-2, 13-3), an outdoor heat exchanger 14, a blower 15, an accumulator 16, and an outdoor unit-control unit 17.

The compressor 11, the four-way valve 12, the pressure reduction mechanisms 13 (13-1, 13-2, and 13-3), the outdoor heat exchanger 14, the accumulator 16, the indoor heat exchanger 21 of the indoor air unit 20, and the refrigerant-water heat exchanger 31 of the indoor hot water unit 30 are connected through refrigerant pipes and constitute a refrigerant circuit RC1. For the refrigerant circuit RC1, for example, a natural refrigerant such as R410A, R32, HFO-1234yf, or a hydrocarbon, or the like can be used.

The compressor 11 is connected between the accumulator 16 and the four-way valve 12 through the refrigerant pipe. The compressor 11 compresses the refrigerant supplied from the accumulator 16 and discharges a high-temperature and high-pressure refrigerant to the four-way valve 12.

The four-way valve 12 is a cooling/heating-switching unit that switches the refrigerant circuit RC1 to either a heating circuit connection for performing a heating operation or a cooling circuit connection for performing a cooling operation. In FIG. 1, the heating circuit connection is shown when the four-way valve 12 has a connection described by solid lines and the cooling circuit connection is shown when the four-way valve 12 has a connection described by dashed lines. The four-way valve 12 is connected to the refrigerant circuit RC1 that causes a refrigerant to flow from the compressor 11 to the two indoor air units 20 and the indoor hot water unit 30 in the case of the heating circuit connection. Also, the four-way valve 12 is connected to the refrigerant circuit RC1 that causes a refrigerant to flow from the compressor 11 to the outdoor heat exchanger 14 in the case of the cooling circuit connection.

The pressure reduction mechanism 13 is disposed beside the branch port 52 after a branch of the refrigerant circuit RC1 to reduce the pressure of the refrigerant. Also, the pressure reduction mechanism 13 can close the refrigerant circuit RC1. In the present embodiment, the pressure reduction mechanism 13-1, the pressure reduction mechanism 13-2, and the pressure reduction mechanism 13-3 have the same configuration and are described as pressure reduction mechanisms 13 when any pressure reduction mechanisms provided in the outdoor unit 10 are indicated or when they are not particularly distinguished.

Also, in the present embodiment, the branch port 51-1, the branch port 51-2, and the branch port 51-3 are branch ports on the four-way valve 12 side and are described as branch ports 51 when any branch ports provided on the four-way valve 12 side in the outdoor unit 10 are indicated or when they are not particularly distinguished. Also, in the present embodiment, the branch port 52-1, the branch port 52-2, and the branch port 52-3 are branch ports on the pressure reduction mechanism 13-1 side and are described as branch ports 52 when any branch ports provided on the pressure reduction mechanism 13-1 side in the outdoor unit 10 are indicated or when they are not particularly distinguished.

The outdoor heat exchanger 14 is a heat exchanger disposed between the pressure reduction mechanism 13 and the four-way valve 12 of the refrigerant circuit RC1. The outdoor heat exchanger 14 performs the heat exchange between the refrigerant flowing through the refrigerant circuit RC1 and the air blown by the blower 15.

The blower 15 is an outdoor fan and blows external air of the outdoor unit 10 into the outdoor heat exchanger 14.

The accumulator 16 is disposed at a position before the refrigerant is supplied to the compressor 11 in the refrigerant circuit RC1. The accumulator 16 is a liquid separator that separates a refrigerant liquid that is not completely evaporated in the refrigerant circuit RC1.

The outdoor unit-control unit 17 includes, for example, a central processing unit (CPU), and controls the outdoor unit 10. The outdoor unit-control unit 17 switches a connection of the refrigerant circuit RC1 through the four-way valve 12 between the heating circuit connection and the cooling circuit connection and controls the compressor 11, the pressure reduction mechanism 13, and the blower 15. Also, the outdoor unit-control unit 17 controls the indoor air unit 20 and the indoor hot water unit 30 via a transmission signal line connected to the wiring port 71. Details of the functions of the outdoor unit-control unit 17 are described below with reference to FIG. 2.

Also, in the present embodiment, a wiring port 71-1, a wiring port 71-2, and a wiring port 71-3 are described as wiring ports 71 when any wiring ports provided in the outdoor unit 10 are indicated or when they are not particularly distinguished.

Also, the outdoor unit 10 includes a pressure sensor 201, a temperature sensor 202, a temperature sensor 206, a temperature sensor 207, and a temperature sensor 208.

The pressure sensor 201 is disposed on a discharge side of the compressor 11 and measures a pressure of the refrigerant on the discharge side of the compressor 11.

The temperature sensor 202 is disposed on the discharge side of the compressor 11 and measures a temperature of the refrigerant flowing through the discharge side of the compressor 11.

The temperature sensor 206 is disposed on the outdoor heat exchanger 14 and measures a temperature of the refrigerant in the outdoor heat exchanger 14.

The temperature sensor 207 is disposed on an air intake port of the blower 15 and measures a temperature of air sucked into the outdoor unit 10.

The temperature sensor 208 is disposed on the pressure reduction mechanism 13 side of the outdoor heat exchanger 14 and measures a temperature of the refrigerant flowing through the pressure reduction mechanism 13 side of the outdoor heat exchanger 14.

The indoor air unit 20-1 and the indoor air unit 20-2 are disposed inside of the building (indoors) and can execute a heating operation of heating the inside of the building and a cooling operation of cooling the inside of the building according to the heat exchange between the air and the refrigerant flowing through the refrigerant circuit RC1. Also, the indoor air unit 20-1 and the indoor air unit 20-2 have the same configuration and are described as indoor air units 20 when any indoor air units provided in the multi-split type air-conditioning device 100 are indicated or when they are not particularly distinguished.

The indoor air unit 20-1 is connected to a branch port 51-1 of the outdoor unit 10 through a pipe 61-1 that is a liquid pipe and is connected to a branch port 52-1 of the outdoor unit 10 through a pipe 62-1 that is a gas pipe. The indoor air unit 20-1 includes an indoor heat exchanger 21-1, a blower 22-1, an indoor air unit-control unit 23-1, a wiring port 72-1, a temperature sensor 203-1, a temperature sensor 204-1, and a temperature sensor 205-1.

The indoor heat exchanger 21-1 is an air heat exchanger that performs the heat exchange of indoor air using heat supplied from the outdoor unit 10.

The blower 22-1 is an indoor fan that blows indoor air into the indoor heat exchanger 21-1. The blower 22-1 can adjust an air flow rate by controlling the indoor air unit-control unit 23-1.

The indoor air unit-control unit 23-1 includes, for example, a CPU, and controls the indoor air unit 20-1. The indoor air unit-control unit 23-1 is connected to the outdoor unit-control unit 17 via the wiring port 71-1 and the wiring port 72-1 through a transmission signal line SL1. Here, the wiring port 72-1 is a wiring port on the indoor air unit 20-1 side for connecting the transmission signal line SL1. The indoor air unit-control unit 23-1 executes various types of control within the indoor air unit 20-1 on the basis of transmission signals including control commands from the outdoor unit-control unit 17.

The temperature sensor 203-1 is disposed on the indoor heat exchanger 21-1 and measures a temperature of the refrigerant in the indoor heat exchanger 21-1.

The temperature sensor 204-1 is disposed on the air intake port and measures a temperature of air sucked into the indoor air unit 20-1.

The temperature sensor 205-1 is disposed on the pipe 62-1 side of the indoor heat exchanger 21-1 and measures a temperature of the refrigerant.

The indoor air unit 20-2 is connected to a branch port 51-2 of the outdoor unit 10 through a pipe 61-2 that is a liquid pipe and is connected to a branch port 52-2 of the outdoor unit 10 through a pipe 62-2 that is a gas pipe. The indoor air unit 20-2 includes an indoor heat exchanger 21-2, a blower 22-2, an indoor air unit-control unit 23-2, a wiring port 72-2, a temperature sensor 203-2, a temperature sensor 204-2, and a temperature sensor 205-2.

The indoor heat exchanger 21-2 is an air heat exchanger that performs the heat exchange of indoor air using heat supplied from the outdoor unit 10.

The blower 22-2 is an indoor fan that blows indoor air into the indoor heat exchanger 21-2. The blower 22-2 can adjust an air flow rate by controlling the indoor air unit-control unit 23-2.

The indoor air unit-control unit 23-2 includes, for example, a CPU, and controls the indoor air unit 20-2. The indoor air unit-control unit 23-2 is connected to the outdoor unit-control unit 17 via the wiring port 71-2 and the wiring port 72-2 through a transmission signal line SL2. Here, the wiring port 72-2 is a wiring port on the indoor air unit 20-2 side for connecting the transmission signal line SL2. The indoor air unit-control unit 23-2 executes various types of control in the indoor air unit 20-2 on the basis of transmission signals including control commands from the outdoor unit-control unit 17.

The temperature sensor 203-2 is disposed on the indoor heat exchanger 21-2 and measures a temperature of the refrigerant in the indoor heat exchanger 21-2.

The temperature sensor 204-2 is disposed on the air intake port and measures a temperature of air sucked into the indoor air unit 20-2.

The temperature sensor 205-2 is disposed on the pipe 62-2 side of the indoor heat exchanger 21-2 and measures a temperature of the refrigerant.

The indoor hot water unit 30 is an indoor unit disposed inside of a building and including a water circuit RC2. In the water circuit RC2, the water medium circulates as a medium for heat exchange. The indoor hot water unit 30 can perform a hot water heating operation of heating the inside of the building and a hot water supply operation of supplying hot water according to heat exchange between the water medium flowing through the water circuit RC2 and the refrigerant flowing through the refrigerant circuit RC1.

The indoor hot water unit 30 is connected to a branch port 51-3 of the outdoor unit 10 through a pipe 61-3 that is a liquid pipe and is connected to a branch port 52-3 of the outdoor unit 10 through a pipe 62-3 that is a gas pipe. The indoor hot water unit 30 includes a refrigerant-water heat exchanger 31, a three-way valve 32, a water-water heat exchanger 33, a water pump 34, a water pump 36, a hot water storage tank 35, an indoor hot water unit-control unit 38, and a wiring port 72-3.

The water circuit RC2 includes the refrigerant-water heat exchanger 31, the three-way valve 32, the water-water heat exchanger 33, and the water pump 34. In the water circuit RC2, the water medium circulates in the order of the water pump 34, the refrigerant-water heat exchanger 31, the three-way valve 32, the water-water heat exchanger 33, and the water pump 34.

The refrigerant-water heat exchanger 31 is a heat exchanger for performing heat exchange between the refrigerant in the refrigerant circuit RC1 and the water medium in the water circuit RC2. The refrigerant-water heat exchanger 31 performs heat exchange of the water medium supplied from the water pump 34 and supplies the water medium to the three-way valve 32.

The three-way valve 32 is disposed between the refrigerant-water heat exchanger 31 and the water-water heat exchanger 33 and is connected to communicate with the refrigerant-water heat exchanger 31, the hot water-heating unit 37-1, and the hot water-heating unit 37-2 in the water circuit RC2.

The hot water-heating unit 37-1 and the hot water-heating unit 37-2 are connected to the water circuit RC2 via the three-way valve 32. The hot water-heating unit 37-1 and the hot water-heating unit 37-2 are connected to the three-way valve 32 through the pipe 64 and are connected to the water circuit RC2 through the pipe 63 at a branch point P1 between the water pump 34 and the water-water heat exchanger 33. The hot water-heating unit 37-1 and the hot water-heating unit 37-2 include, for example, a radiator, a fan coil, hot water floor heating, or the like, and heat the inside by exchanging heat between indoor air and the water medium.

Also, the hot water-heating unit 37-1 and the hot water-heating unit 37-2 have the same configuration and are described as hot water-heating units 37 when any hot water-heating units provided in the multi-split type air-conditioning device 100 are indicated or when they are not particularly distinguished.

The water-water heat exchanger 33 is disposed between the three-way valve 32 and the water pump 34 and the water stored in the hot water storage tank 35 (low-temperature city water) is boiled to generate hot water by exchanging heat with the water medium of the water circuit RC2.

The water pump 34 is disposed between the water-water heat exchanger 33 and the refrigerant-water heat exchanger 31 to circulate the water medium in the water circuit RC2. For example, the water pump 34 is configured such that a rotational speed (a water amount) can be changed by an inverter. The water pump 34 is a primary-side pump that circulates a primary-side water medium in the water-water heat exchanger 33.

The hot water storage tank 35 is, for example, a full water tank, and is connected to the secondary side of the water-water heat exchanger 33 via the water pump 36. The hot water storage tank 35 stores hot water boiled by the water-water heat exchanger 33, and the hot water is discharged from the upper part of the tank in response to a hot water discharge request. Also, low-temperature city water is supplied to the hot water storage tank 35 from the lower part of the tank by an amount of discharged water.

The water pump 36 is disposed between the hot water storage tank 35 and the water-water heat exchanger 33 and circulates the water medium on the secondary side of the water-water heat exchanger 33. For example, the water pump 36 is configured such that the rotational speed (the water amount) can be changed by the inverter. The water pump 36 is a secondary-side pump that circulates the water medium on the secondary side in the water-water heat exchanger 33.

The indoor hot water unit-control unit 38 includes, for example, a CPU, and controls the indoor hot water unit 30. The indoor hot water unit-control unit 38 is connected to the outdoor unit-control unit 17 via the wiring port 71-3 and the wiring port 72-3 through a transmission signal line SL3. Here, the wiring port 72-3 is a wiring port on the indoor hot water unit 30 side for connecting the transmission signal line SL3. The indoor hot water unit-control unit 38 executes various types of control within the indoor hot water unit 30 on the basis of transmission signals including control commands from the outdoor unit-control unit 17. Details of the functions of the indoor hot water unit-control unit 38 are described below with reference to FIG. 2.

Also, the indoor hot water unit 30 includes a temperature sensor 209, a temperature sensor 210, a temperature sensor 211, and a temperature sensor 212.

The temperature sensor 209 is disposed on the pipe 62-3 side of the refrigerant circuit RC1 in the refrigerant-water heat exchanger 31 and measures a temperature of the refrigerant.

The temperature sensor 210 is disposed on an upstream side of the water circuit RC2 in the refrigerant-water heat exchanger 31 and measures a temperature of the water medium supplied to the refrigerant-water heat exchanger 31.

The temperature sensor 211 is disposed on a downstream side of the water circuit RC2 in the refrigerant-water heat exchanger 31 and measures a temperature of the water medium discharged from the refrigerant-water heat exchanger 31.

The temperature sensor 212 is disposed on the hot water storage tank 35 and measures a temperature of the water medium (hot water) stored in the hot water storage tank 35.

Also, in FIG. 1, when the refrigerant circuit RC1 performs a heating operation (or has a heating circuit connection), the refrigerant circulates in the order of the compressor 11, the branch port 51, the indoor unit (the indoor heat exchanger 21 of the indoor air unit 20 and the refrigerant-water heat exchanger 31 of the indoor hot water unit 30), the branch port 52, the pressure reduction mechanism 13, the outdoor heat exchanger 14, the accumulator 16, and the compressor 11.

Also, when the refrigerant circuit RC1 performs a cooling operation (or has a cooling circuit connection), the refrigerant circulates in the order of the compressor 11, the outdoor heat exchanger 14, the pressure reduction mechanism 13, the branch port 52, the indoor unit (the indoor heat exchanger 21 of the indoor air unit 20), the branch port 51, the accumulator 16, and the compressor 11.

The external controller 40 is, for example, a terminal device such as a tablet-type personal computer or a smartphone. The external controller 40 is used when a connection determination process of determining the connections between the outdoor unit 10 and the indoor units (the indoor air unit 20-1, the indoor air unit 20-2, and the indoor hot water unit 30) is performed. Details of the functions of the external controller 40 are described below with reference to FIG. 2.

Next, the functional block of the multi-split type air-conditioning device 100 according to the present embodiment is described with reference to FIG. 2.

Figure 2:
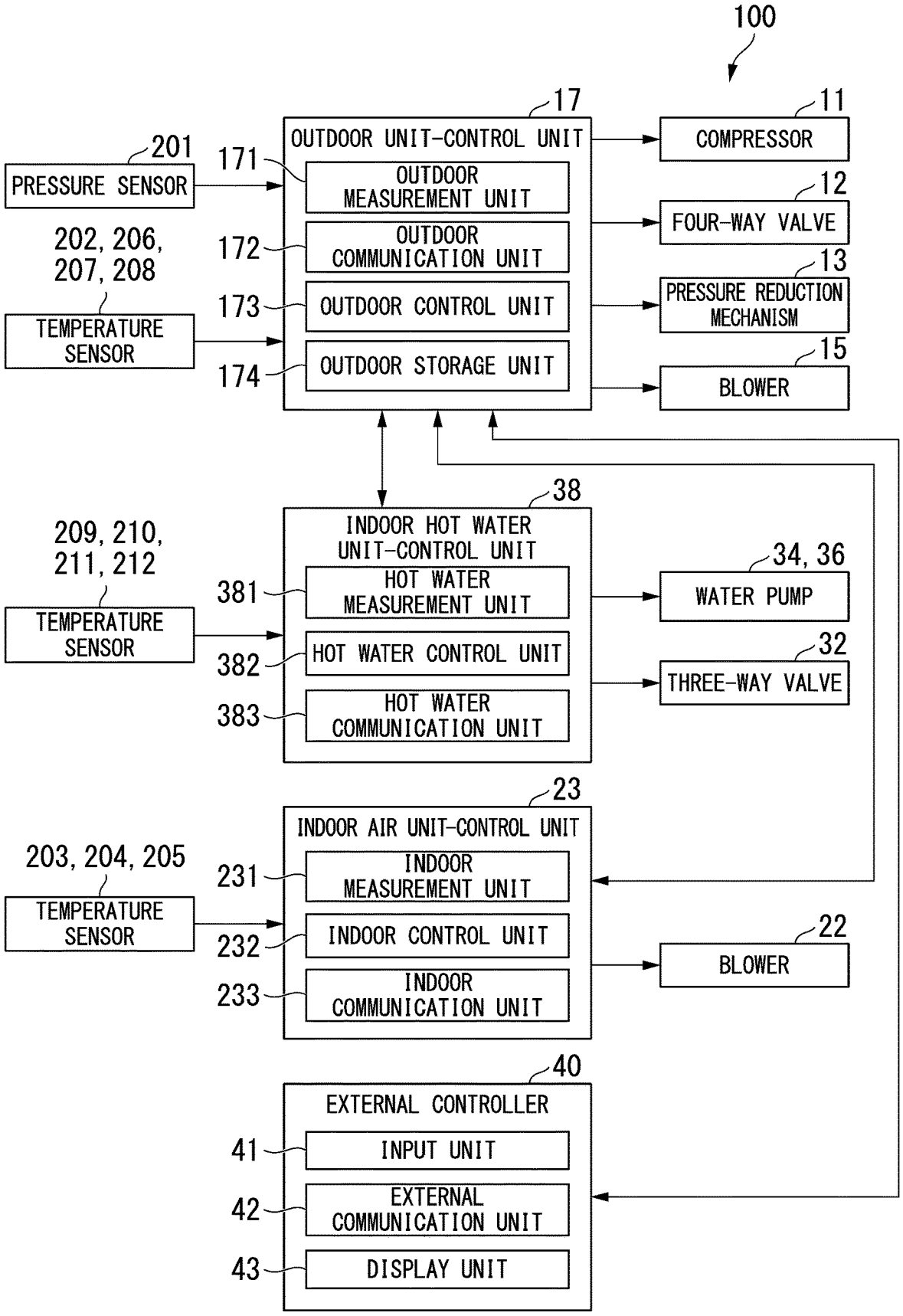
FIG. 2 is a functional block diagram showing an example of the multi-split type air-conditioning device according to the embodiment.

FIG. 2 is a functional block diagram showing an example of the multi-split type air-conditioning device 100 according to the present embodiment.

As shown in FIG. 2, the multi-split type air-conditioning device 100 includes an outdoor unit-control unit 17, an indoor air unit-control unit 23, an indoor hot water unit-control unit 38, and an external controller 40. Also, because the indoor air unit 20-1 and the indoor air unit 20-2 have the same configuration, each configuration provided in the indoor air unit 20-1 and the indoor air unit 20-2 is described as the blower 22, the indoor air unit-control unit 23, the temperature sensor 203, the temperature sensor 204, and the temperature sensor 205 herein.

The indoor air unit-control unit 23 includes an indoor measurement unit 231, an indoor control unit 232, and an indoor communication unit 233.

The indoor measurement unit 231 acquires various types of temperatures measured by the temperature sensor 203, the temperature sensor 204, and the temperature sensor 205.

The indoor communication unit 233 performs communication with the outdoor unit-control unit 17 or receives various types of control information from a remote controller (not shown). The indoor communication unit 233 receives, for example, a control command from the outdoor unit-control unit 17 according to a transmission signal. Also, the indoor communication unit 233 transmits various types of temperatures acquired by the indoor measurement unit 231 to the outdoor unit-control unit 17 on the basis of a request from the outdoor unit-control unit 17. Also, the indoor communication unit 233 transmits various types of requests based on the control information received from the remote controller to the outdoor unit-control unit 17.

The indoor control unit 232 controls the blower 22 on the basis of control commands from the outdoor unit-control unit 17, various types of control information from the remote controller, or various types of temperatures acquired by the indoor measurement unit 231.

The indoor hot water unit-control unit 38 includes a hot water measurement unit 381, a hot water control unit 382, and a hot water communication unit 383.

The hot water measurement unit 381 acquires various types of temperatures measured by the temperature sensor 209, the temperature sensor 210, the temperature sensor 211, and the temperature sensor 212.

The hot water communication unit 383 performs communication with the outdoor unit-control unit 17 or receives various types of control information from the remote controller (not shown). The hot water communication unit 383 receives, for example, a control command from the outdoor unit-control unit 17 based on a transmission signal. Also, the hot water communication unit 383 transmits various types of temperatures acquired by the hot water measurement unit 381 to the outdoor unit-control unit 17 on the basis of a request from the outdoor unit-control unit 17. Also, the hot water communication unit 383 transmits various types of requests based on the control information received from the remote controller to the outdoor unit-control unit 17.

The hot water control unit 382 controls the three-way valve 32, the water pump 34, and the water pump 36 on the basis of control commands from the outdoor unit-control unit 17, various types of control information from the remote controller, or various types of temperatures acquired by the hot water measurement unit 381.

The external controller 40 includes an input unit 41, an external communication unit 42, and a display unit 43.

The input unit 41 is, for example, an input device such as a keyboard or a touch panel, and receives input information according to an operation of a user such as an operator.

The external communication unit 42 performs communication with the outdoor unit-control unit 17 through, for example, a telephone circuit, a LAN circuit, a wireless link, or the like. The external communication unit 42 transmits various types of commands and instruction requests based on the input information received by the input unit 41 to the outdoor unit-control unit 17. Also, the external communication unit 42 receives response information for various types of commands and instruction requests or the like from the outdoor unit-control unit 17.

The display unit 43 is, for example, a display device such as a liquid crystal display and displays various types of information. The display unit 43 displays display information corresponding to an operation on the input unit 41 and display information based on response information received by the external communication unit 42 from the outdoor unit-control unit 17 or the like. For example, the display unit 43 displays results of determining connections between the outdoor unit 10 and the indoor units (the indoor air unit 20-1, the indoor air unit 20-2, and the indoor hot water unit 30) and the like on the basis of the response information received from the outdoor unit-control unit 17.

The outdoor unit-control unit 17 includes an outdoor measurement unit 171, an outdoor communication unit 172, an outdoor control unit 173, and an outdoor storage unit 174.

The outdoor measurement unit 171 acquires a pressure measured by the pressure sensor 201 and various types of temperatures measured by the temperature sensor 202, the temperature sensor 206, the temperature sensor 207, and the temperature sensor 208.

The outdoor communication unit 172 performs communication with the external communication unit 42 of the external controller 40 through, for example, a telephone circuit, a LAN circuit, a wireless link, or the like. Also, the outdoor communication unit 172 performs communication between the indoor hot water unit 30 and the indoor air unit 20 via a transmission signal line. The outdoor communication unit 172 transmits a control command to the indoor hot water unit 30 and the indoor air unit 20 according to, for example, a transmission signal. Also, the outdoor communication unit 172 receives various types of temperatures from the hot water communication unit 383 of the indoor hot water unit 30 and the indoor communication unit 233 of the indoor air unit according to, for example, a transmission signal.

The outdoor storage unit 174 (an example of the corresponding information storage unit) includes, for example, a semiconductor memory or the like, and stores operating state amounts such as a temperature and a pressure, set values, various types of information of the indoor unit, and the like. For example, the outdoor storage unit 174 stores corresponding information in which indoor unit identification information for identifying a control target indoor unit and branch port identification information for identifying the branch port 52 are associated. Here, an example of data of corresponding information stored by the outdoor storage unit 174 is described with reference to FIG. 3.

FIG. 3 is a diagram showing an example of data of the outdoor storage unit 174 in the present embodiment.

As shown in FIG. 3, the outdoor storage unit 174 stores corresponding information in which an "indoor unit," a "branch port ID," and a "wiring port ID" are associated with each other.

In FIG. 3, the "indoor unit" indicates an indoor unit name and is an example of indoor unit identification information for identifying a control target indoor unit. Also, the "branch port ID" and the "wiring port ID" indicate connection destination information. The "branch port ID" indicates branch port identification information for identifying the branch port 52 and the "wiring port ID" indicates wiring port identification information for identifying the wiring port 71.

Also, in the example shown in FIG. 3, the indoor unit name of the indoor hot water unit 30 is indicated by "indoor hot water unit" and the indoor unit name of the indoor air unit 20-1 and the indoor unit name of the indoor air unit 20-1 are indicated by "indoor air unit A" and "indoor air unit B," respectively. Also, the "branch port ID" of the branch port 52-1 is denoted by "B01," the "branch port ID" of the branch port 52-2 is denoted by "B02," and the "branch port ID" of the branch port 52-3 is denoted by "B03." Also, the "wiring port ID" of the wiring port 71-1 is denoted by "L01," the "wiring port ID" of the wiring port 71-2 is denoted by "L02," and the "wiring port ID" of the wiring port 71-3 is denoted by "L03."

For example, in the example shown in FIG. 3, it is shown that the indoor hot water unit 30, which is the "indoor hot water unit," is connected to "B03" (the branch port 52-3) and "L03" (the wiring port 71-3). Also, it is shown that the indoor air unit 20-1, which is the "indoor air unit A," is connected to "B01" (the branch port 52-1) and "L01" (the wiring port 71-1).

Returning to the description of FIG. 2, the outdoor control unit 173 controls the compressor 11, the four-way valve 12, the pressure reduction mechanism 13, and the blower 15 on the basis of various types of information received from the external controller 40, the indoor air unit-control unit 23, and the indoor hot water unit-control unit 38 or a pressure and various types of temperatures acquired by the outdoor measurement unit 171. The outdoor control unit 173 executes, for example, a process of switching an operation of the refrigerant circuit RC1 between a heating operation (a heating circuit connection) and a cooling operation (a cooling circuit connection) and a process of transmitting control commands to the indoor air unit-control unit 23 and the indoor hot water unit-control unit 38 via the outdoor communication unit 172. The outdoor control unit 173 controls the refrigerant circuit RC1 and transmits control commands for the indoor hot water unit 30 and the indoor air unit 20 via a transmission signal line. Also, when the outdoor control unit 173 transmits control commands to the indoor air unit-control unit 23 and the indoor hot water unit-control unit 38, the indoor air unit 20 and the indoor hot water unit 30 are controlled on the basis of the corresponding information stored by the outdoor storage unit 174 shown in FIG. 3 described above.

Also, when the operator installs the multi-split type air-conditioning device 100 in the building, the outdoor control unit 173 executes a connection determination process of determining whether or not there is a connection error of the indoor unit (the indoor air unit 20-1, the indoor air unit 20-2, and the indoor hot water unit 30). The outdoor control unit 173 executes an indoor hot water unit-determination process and an indoor air unit-determination process as the connection determination process. In the indoor hot water unit-determination process, the outdoor control unit 173 executes a process of causing the refrigerant circuit RC1 to perform a heating operation, causing a refrigerant to flow through branch ports 52 sequentially using the pressure reduction mechanism 13, and determining the branch port 52 to which the indoor hot water unit 30 is connected.

The outdoor control unit 173 determines the branch port 52 to which the indoor hot water unit 30 is connected on the basis of, for example, the temperature of the water medium at the inlet of the refrigerant-water heat exchanger 31 and the temperature of the water medium at the outlet of the refrigerant-water heat exchanger 31, in the indoor hot water unit-determination process. That is, the outdoor control unit 173 sequentially opens the pressure reduction mechanisms 13, causes the refrigerants to sequentially flow through the branch ports 52 corresponding to the pressure reduction mechanisms 13, and acquires a temperature measured by the temperature sensor 210 and a temperature measured by the temperature sensor 211 via the outdoor communication unit 172. The outdoor control unit 173 determines the branch port 52 to which the indoor hot water unit 30 is connected by confirming that the temperature measured by the temperature sensor 211 is higher than the temperature measured by the temperature sensor 210.

Also, the outdoor control unit 173 causes the water amount of water circulating in the water circuit RC2 to be smaller in the indoor hot water unit-determination process than the water amount when the water circuit RC2 is normally operated. That is, the outdoor control unit 173 transmits a control command for reducing the water amount of the water pump 34 to the hot water control unit 382 via the outdoor communication unit 172 in the indoor hot water unit-determination process.

Also, when the indoor hot water unit-determination process is being executed, the outdoor control unit 173 causes the blower 22 to blow an air with an air volume less than an air volume when the indoor air unit 20 is normally operated. That is, when the indoor hot water unit-determination process is being executed, the outdoor control unit 173 transmits a control command for reducing the air volume of the air from the blower 22 to the indoor control unit 232 via the outdoor communication unit 172.

Also, in the indoor air unit-determination process, after the indoor hot water unit-determination process is executed, the outdoor control unit 173 executes a process of causing the refrigerant circuit RC1 to perform a cooling operation, causing a refrigerant to flow through branch ports 52 sequentially to which the indoor hot water unit 30 is not connected, and determining a connection relationship between the branch port 52 to which the indoor air unit 20 is connected and the indoor air unit 20. In the indoor air unit-determination process, the outdoor control unit 173 determines a connection relationship between the branch port 52 to which the indoor air unit 20 is connected and the indoor air unit 20 on the basis of, for example, the temperature of the intake air and the temperature of the refrigerant in the indoor heat exchanger 21.

In the indoor air unit-determination process, the outdoor control unit 173 causes the refrigerant circuit RC1 to perform a cooling operation with respect to the remaining two branch ports 52 other than the branch port 52 to which the indoor hot water unit 30 is connected among the three branch ports 52, sequentially opens the pressure reduction mechanisms 13 corresponding to the two branch ports 52, and causes the refrigerants to sequentially flow through the two branch ports 52. The outdoor control unit 173 acquires the temperature measured by the temperature sensor 204 and the temperature measured by the temperature sensor 203 via the outdoor communication unit 172. The outdoor control unit 173 determines a connection relationship between the branch port 52 to which the indoor air unit 20 is connected and the indoor air unit 20 by confirming that the temperature measured by the temperature sensor 203 is lower than the temperature measured by the temperature sensor 204.

Also, when the indoor air unit-determination process is being executed, the outdoor control unit 173 causes the water circuit RC2 to circulate water with a water amount larger than a water amount when the indoor hot water unit-determination process is being executed. That is, during the execution of the indoor air unit-determination process, the outdoor control unit 173 transmits a control command for increasing the water amount of water to a water amount larger than that during the execution of the indoor hot water unit-determination process of the water pump 34 to the hot water control unit 382 via the outdoor communication unit 172.

Also, the outdoor control unit 173 causes the display unit 43 to display information indicating the determination result of the indoor hot water unit-determination process and the determination result of the indoor air unit-determination process. That is, the outdoor control unit 173 transmits the determination result of the connection determination process to the external controller 40 via the outdoor communication unit 172 and causes the display unit 43 of the external controller 40 to display the determination result of the connection determination process.

Also, the outdoor control unit 173 changes a corresponding relationship between a control target indoor unit, which is the indoor hot water unit 30 or the indoor air unit 20, and the branch port 52 such that the control target indoor unit corresponds to the branch port 52 to which the control target indoor unit is connected on the basis of a determination result of the indoor hot water unit-determination process and a determination result of the indoor air unit-determination process. The outdoor control unit 173 causes the outdoor storage unit 174 to store corresponding information corresponding to the indoor hot water unit 30 on the basis of the determination result of the indoor hot water unit-determination process and causes the outdoor storage unit 174 to store corresponding information corresponding to the indoor air unit 20 on the basis of the determination result of the indoor air unit-determination process. The outdoor control unit 173 transmits a control command to the control target indoor unit on the basis of the corresponding information stored by the outdoor storage unit 174.

Next, an operation of the multi-split type air-conditioning device 100 according to the present embodiment is described with reference to the drawings.

First, an operation in each operation mode (action mode) of the multi-split type air-conditioning device 100 is described with reference to FIGS. 1 and 2 described above.

The multi-split type air-conditioning device 100 executes a hot water heating operation mode when a hot water heating operation is designated by the remote controller (not shown). The outdoor control unit 173 performs control for connecting the four-way valve 12 to the heating connection circuit in the hot water heating operation mode. Also, the outdoor control unit 173 opens the pressure reduction mechanism 13-3 and connects the refrigerant circuit RC1 to the indoor hot water unit 30. Also, in this case, the outdoor control unit 173 performs control for closing the pressure reduction mechanism 13-1 and the pressure reduction mechanism 13-2.

Also, the hot water control unit 382 changes an output of the three-way valve 32 such that the refrigerant-water heat exchanger 31 is communicated with the hot water-heating units 37 (37-1 and 37-2). Here, the three-way valve 32 causes the water medium to flow through the pipe 64 and stops and closes the flow of the water medium to the water-water heat exchanger 33 side.

In the hot water heating operation mode, the high-temperature and high-pressure gas refrigerant discharged from the compressor 11 passes through the branch port 51-3 and the pipe 61-3 via the four-way valve 12 and then flows into the refrigerant-water heat exchanger 31. Also, the refrigerant-water heat exchanger 31 heats intermediate water supplied by the water pump 34. Subsequently, the refrigerant is discharged from the refrigerant-water heat exchanger 31, comes to have a pressure reduced by the pressure reduction mechanism 13-3 via the pipe 62-3 and the branch port 52-3, flows into the outdoor heat exchanger 14, performs heat exchange with outdoor air supplied by the blower 15 and becomes a low-pressure gas refrigerant. Subsequently, the low-pressure gas refrigerant discharged from the outdoor heat exchanger 14 passes through the accumulator 16 via the four-way valve 12 and then is suctioned into the compressor 11 again.

In the hot water heating operation mode, the water medium supplied by the water pump 34 of the indoor hot water unit 30 is heated by the refrigerant in the refrigerant-water heat exchanger 31 and then has a high temperature. The water medium having the high temperature passes through the three-way valve 32 and the pipe 64 and performs heat exchange with indoor air at an installation position, and the temperature of the water medium is lowered by the hot water-heating units 37 (37-1 and 37-2). Subsequently, the water medium flows into the water pump 34 again via the pipe 63 and the branch point P1. Also, here, the hot water control unit 382 performs control for stopping the water pump 36.

Next, an operation of the hot water supply operation mode of the multi-split type air-conditioning device 100 is described.

The multi-split type air-conditioning device 100 executes a hot water supply operation mode (a hot water supply action mode) when a hot water supply operation is designated by the remote controller (not shown). The outdoor control unit 173 performs control for connecting the four-way valve 12 to the heating connection circuit in the hot water supply operation mode. Also, the outdoor control unit 173 opens the pressure reduction mechanism 13-3 and connects the refrigerant circuit RC1 to the indoor hot water unit 30. Also, in this case, the outdoor control unit 173 performs control for closing the pressure reduction mechanism 13-1 and the pressure reduction mechanism 13-2. The outdoor control unit 173 controls an operating frequency of the compressor 11 by fixing a maximum frequency to avoid running out of hot water.

Also, the hot water control unit 382 changes the output of the three-way valve 32 to connect the refrigerant-water heat exchanger 31 and the water-water heat exchanger 33. Here, the three-way valve 32 stops and closes the flow of the water medium toward the pipe 64 side.

In the hot water supply operation mode, the water medium supplied by the water pump 34 of the indoor hot water unit 30 is heated by the refrigerant in the refrigerant-water heat exchanger 31 and has a high temperature. Also, the high-temperature water medium passes through the three-way valve 32, flows into the water-water heat exchanger 33, and heats the water flowing from the hot water storage tank 35, and the temperature of the water medium is lowered. Subsequently, the water medium is supplied to the refrigerant-water heat exchanger 31 via the water pump 34 and becomes hot water in the refrigerant-water heat exchanger 31.

On the other hand, the hot water in the hot water storage tank 35 is supplied by the water pump 36 fixed at a prescribed rotational speed and flows into the water-water heat exchanger 33 via the water pump 36. The hot water supplied by the water pump 36 receives heat from the water medium flowing through the three-way valve 32, comes to have a high temperature, and flows into the hot water storage tank 35. In this process, water is boiled into the hot water storage tank 35. Other operations are similar to those described above in the hot water heating operation mode.

Next, an operation of the cooling operation mode of the multi-split type air-conditioning device 100 is described.

The multi-split type air-conditioning device 100 executes a cooling operation mode when the cooling operation is designated by the remote controller (not shown). The outdoor control unit 173 performs control for connecting the four-way valve 12 to the cooling connection circuit in the cooling operation mode. Also, the outdoor control unit 173 opens the pressure reduction mechanism 13-1 and the pressure reduction mechanism 13-2 and connects the refrigerant circuit RC1 to the indoor air unit 20-1 and the indoor air unit 20-2. Also, in this case, the outdoor control unit 173 performs control for closing the pressure reduction mechanism 13-3. Also, the hot water control unit 382 stops the water pump 34 and the water pump 36.

In the cooling operation mode, a high-temperature and high-pressure gas refrigerant discharged from the compressor 11 flows into the outdoor heat exchanger 14 via the four-way valve 12, dissipates heat to outdoor air blown by the blower 15, and becomes a high-pressure liquid refrigerant. Subsequently, the refrigerant is discharged from the outdoor heat exchanger 14, comes to have a pressure reduced by the pressure reduction mechanism 13-1 and the pressure reduction mechanism 13-2, and becomes a low-pressure two-phase refrigerant. The low-pressure two-phase refrigerant is discharged from the outdoor unit 10 via the branch port 52-1 and the branch port 52-2 and flows into the indoor air unit 20-1 and the indoor air unit 20-2 via the pipe 62-1 and the pipe 62-2 which are liquid pipes.

Subsequently, the refrigerant cools the indoor air by the indoor heat exchanger 21-1 and the indoor heat exchanger 21-2 and becomes a low-pressure gas refrigerant. The low-pressure gas refrigerant is discharged from the indoor heat exchanger 21-1 and the indoor heat exchanger 21-2, flows into the outdoor unit 10 via the pipe 61-1, the pipe 61-2, the branch port 51-1, and the branch port 51-2, and suctions into the compressor 11 again after flowing through the accumulator 16.

Next, the connections between the outdoor unit 10 and the indoor units (the indoor air unit 20-1, the indoor air unit 20-2, and the indoor hot water unit 30) are described with reference to FIGS. 4 and 5.

In the multi-split type air-conditioning device 100, the outdoor unit 10 and the indoor units (the indoor air unit 20-1, the indoor air unit 20-2, and the indoor hot water unit 30) are connected through the pipes 61 and 62 and transmission signal lines in the refrigerant circuit RC1. The transmission signal line is a signal line for communicating operation states, operation modes and control commands for the indoor units (the indoor air unit 20-1, the indoor air unit 20-2, and the indoor hot water unit 30), and the like.

FIG. 4 is a diagram showing an example of a connection of the refrigerant pipe and a connection of the transmission signal line of the multi-split type air-conditioning device 100 according to the present embodiment. Also, FIG. 4 shows an example in which the outdoor unit 10 and the indoor units (the indoor air unit 20-1, the indoor air unit 20-2, and the indoor hot water unit 30) are connected normally.

In the connection shown in FIG. 4, the branch port 51-1 and the branch port 52-1 of the outdoor unit 10 and the indoor air unit 20-1 are connected through pipes and the wiring port 71-1 of the outdoor unit 10 and the wiring port 72-1 of the indoor air unit 20-1 are connected through a transmission signal line SL1. Also, the branch port 51-2 and the branch port 52-2 of the outdoor unit 10 and the indoor air unit 20-2 are connected through pipes and the wiring port 71-2 of the outdoor unit 10 and the wiring port 72-2 of the indoor air unit 20-2 are connected through the transmission signal line SL2. Also, the branch port 51-3 and the branch port 52-3 of the outdoor unit 10 and the indoor hot water unit 30 are connected through pipes and the wiring port 71-3 of the outdoor unit 10 and the wiring port 72-3 of the indoor hot water unit 30 are connected through the transmission signal line SL3.

The outdoor control unit 173 of the outdoor unit-control unit 17 acquires which of three sets of branch ports 51 and 52 the indoor air unit 20-1, the indoor air unit 20-2, and the indoor hot water unit 30 are connected to through pipes on the basis of corresponding information of the outdoor storage unit 174 from connection states of the transmission signal line SL1, the transmission signal line SL2, and the transmission signal line SL3. The outdoor control unit 173 determines pressure reduction mechanisms 13 respectively corresponding to the indoor air unit 20-1, the indoor air unit 20-2, and the indoor hot water unit 30 on the basis of the acquired corresponding information.

Specifically, when the indoor hot water unit 30 changes from a stop to a hot water supply operation by the command, the outdoor control unit 173 opens the pressure reduction mechanism 13-3 on the basis of the corresponding information stored by the outdoor storage unit 174. Here, the corresponding information is, for example, the above-described information as shown in FIG. 3. For example, the outdoor storage unit 174 may be configured to set and store corresponding information between the indoor hot water unit 30 and the pressure reduction mechanism 13-3 as "corresponding information 1," set and store corresponding information between the indoor air unit 20-1 and the pressure reduction mechanism 13-1 as "corresponding information 2," and set and store the corresponding information between the indoor air unit 20-2 and the pressure reduction mechanism 13-2 as "corresponding information 3."

The outdoor control unit 173 controls the pressure reduction mechanism 13-1 from a closed path to an open path when the indoor unit connected to the branch port 52-1 and the wiring port 71-1 is operated. Also, the outdoor control unit 173 controls the pressure reduction mechanism 13-2 from a closed path to an open path when the indoor unit connected to the branch port 52-2 and the wiring port 71-2 is operated. Also, the outdoor control unit 173 controls the pressure reduction mechanism 13-3 from a closed path to an open path when the indoor unit connected to the branch port 52-3 and the wiring port 71-3 is operated.

Meanwhile, in the multi-split type air-conditioning device 100, connections between the outdoor unit 10 and the indoor units (the indoor air unit 20-1, the indoor air unit 20-2, and the indoor hot water unit 30) are established in installation work at the installation site by the operator. Thus, in the multi-split type air-conditioning device 100, for example, as shown in FIG. 5, the outdoor unit 10 and the indoor hot water unit 30 must be connected at the branch port 51-3 and the branch port 52-3 through pipes, but a connection error in which the outdoor unit 10 and the indoor hot water unit 30 are erroneously connected at the branch port 51-1 and the branch port 52-1 through pipes may occur.

FIG. 5 shows an example in which the outdoor unit 10 and the indoor units (the indoor air unit 20-1, the indoor air unit 20-2, and the indoor hot water unit 30) are not normally connected.

In the connection shown in FIG. 5, the indoor hot water unit 30 and the indoor air unit 20-1 are switched and connected. In this case, because it is difficult to normally operate the control of the pressure reduction mechanism 13-1 and the pressure reduction mechanism 13-3 in such connections, it is difficult to normally operate the indoor air unit 20-1 and the indoor hot water unit 30. The multi-split type air-conditioning device 100 according to the present embodiment can perform a connection determination process of determining such an erroneous connection of an indoor unit, and the connection determination process of the multi-split type air-conditioning device 100 is described with reference to FIG. 6.

Figure 6:
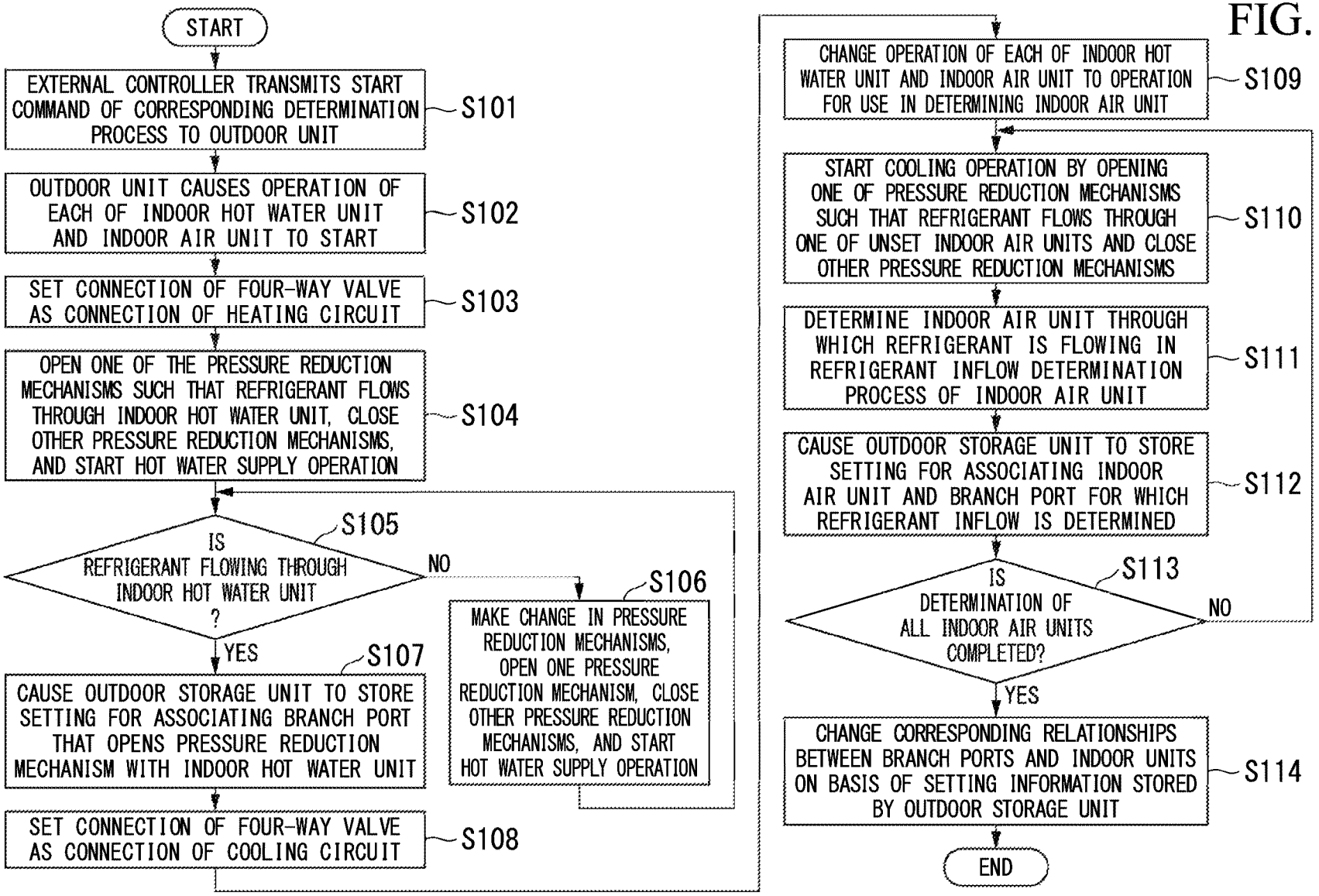
FIG. 6 is a flowchart showing an example of an operation of the multi-split type air-conditioning device according to the embodiment.

FIG. 6 is a flowchart showing an example of an operation of the multi-split type air-conditioning device 100 according to the present embodiment. Here, an example of a corresponding determination process that is the connection determination process of the multi-split type air-conditioning device 100 is described.

As shown in FIG. 6, the external controller 40 transmits a start command of the corresponding determination process to the outdoor unit 10 (step S101). The input unit 41 of the external controller 40 receives an operation of the operator and the external communication unit 42 transmits a start command of the corresponding determination process to the outdoor unit 10.

Subsequently, the outdoor unit 10 causes an operation of each of the indoor hot water unit 30 and the indoor air unit 20 to start (step S102). The outdoor control unit 173 of the outdoor unit 10 causes an operation of each of the indoor hot water unit 30 and the indoor air unit 20 to start via the outdoor communication unit 172 and the transmission signal line. The outdoor control unit 173 transmits a control command to the indoor hot water unit 30, for example, to start operations of the water pump 34 and the water pump 36 and adjust the connection of the three-way valve 32. Specifically, on the basis of the control command from the outdoor control unit 173, the hot water control unit 382 of the indoor hot water unit 30 causes operations of the water pump 34 and the water pump 36 to start and the connection of the three-way valve 32 is set as the connection of the hot water supply operation mode. Also, the outdoor control unit 173 causes a state in which the blower 22 of the indoor air unit 20 is stopped to be maintained.

Subsequently, the outdoor control unit 173 sets the connection of the four-way valve 12 as the connection of the heating circuit (step S103). That is, the outdoor control unit 173 changes a connection of the four-way valve 12 to a heating circuit connection for performing a heating operation and is in a state in which the refrigerant circuit RC1 can execute the heating operation.

Subsequently, the outdoor control unit 173 opens one of the pressure reduction mechanisms 13 such that the refrigerant flows through the indoor hot water unit 30, closes the other pressure reduction mechanisms thereof, and starts a hot water supply operation (step S104). The outdoor control unit 173 opens one of the pressure reduction mechanism 13-1, the pressure reduction mechanism 13-2, and the pressure reduction mechanism 13-3 (for example, the pressure reduction mechanism 13-1) and closes the remaining pressure reduction mechanisms (for example, the pressure reduction mechanism 13-2 and the pressure reduction mechanism 13-3). Also, the outdoor control unit 173 operates the compressor 11, the outdoor heat exchanger 14, and the blower 15 to control the operation of hot water supply operation.

Next, the outdoor control unit 173 determines whether or not a refrigerant is flowing through the indoor hot water unit 30 (step S105). The outdoor control unit 173 acquires an outlet water temperature (a measured temperature of the temperature sensor 211) and an inlet water temperature (a measured temperature of the temperature sensor 210) of the refrigerant-water heat exchanger 31 after the elapse of a prescribed period of time (for example, after the elapse of 10 minutes) from the start of the operation. The outdoor control unit 173 determines that the refrigerant is flowing through the indoor hot water unit 30 when the outlet water temperature of the refrigerant-water heat exchanger 31 is higher than the inlet water temperature by a prescribed value or larger (for example, by 2° C. or higher). The outdoor control unit 173 moves the process to step S107 when the refrigerant is flowing through the indoor hot water unit 30 (step S105: YES). Also, the outdoor control unit 173 moves the process to step S106 when no refrigerant is flowing through the indoor hot water unit 30 (step S105: NO).

In step S106, the outdoor control unit 173 makes a change in the pressure reduction mechanisms 13, opens one pressure reduction mechanism, closes the other pressure reduction mechanisms, and starts a hot water supply operation. After the processing of step S106, the outdoor control unit 173 moves the process to step S105 and makes a change in the pressure reduction mechanisms 13 to make a similar determination.

Also, in step S107, the outdoor control unit 173 causes the outdoor storage unit 174 to store a setting (corresponding information) for associating the branch port 52 that opens the pressure reduction mechanism 13 with the indoor hot water unit 30 (see FIG. 3). Also, the outdoor control unit 173 ends the hot water supply operation.

Subsequently, the outdoor control unit 173 sets the connection of the four-way valve 12 as the connection of the cooling circuit (step S108). That is, the outdoor control unit 173 changes a connection of the four-way valve 12 to a cooling circuit connection for performing a cooling operation, and is in a state in which the refrigerant circuit RC1 can execute the cooling operation.

Subsequently, the outdoor control unit 173 changes the operation of each of the indoor hot water unit 30 and the indoor air unit 20 to an operation for use in determining the indoor air unit 20 (step S109). The outdoor control unit 173 changes the operation of each of the indoor hot water unit 30 and the indoor air unit 20 to an operation for use in a determination via the outdoor communication unit 172 and the transmission signal line. The outdoor control unit 173 raises fan speeds of the blower 22-1 of the indoor air unit 20-1 and the blower 22-2 of the indoor air unit 20-1 and causes air to be blown at the raised speeds. Also, the outdoor control unit 173 is in a state of raising a pump speed without stopping the water pump 34 and the water pump 36 of the indoor hot water unit 30.

Also, in the corresponding determination operation of the indoor air unit 20-1 and the indoor air unit 20-2, because the refrigerant flows in the cooling operation, by preventing the water pump 34 and the water pump 36 from stopping in this way, it is possible to avoid freezing when a cold refrigerant flows into the refrigerant-water heat exchanger 31 unintentionally and to improve the reliability of the multi-split type air-conditioning device 100.

Subsequently, the outdoor control unit 173 starts a cooling operation by opening one of the pressure reduction mechanisms 13 such that the refrigerant flows through one of the unset indoor air units 20 and closes the other pressure reduction mechanisms 13 (step S110). The outdoor control unit 173 opens one pressure reduction mechanism 13 other than the pressure reduction mechanism 13 corresponding to the indoor hot water unit 30 and the pressure reduction mechanism 13 corresponding to the indoor air unit 20 among the three pressure reduction mechanisms 13 and starts the cooling operation by closing the other pressure reduction mechanisms 13.

Subsequently, the outdoor control unit 173 determines the indoor air unit 20 through which the refrigerant is flowing in the refrigerant inflow determination process of the indoor air unit 20 (step S111). The outdoor control unit 173 executes a refrigerant inflow determination process of the indoor air unit 20 after the elapse of a prescribed period of time (for example, after the elapse of 10 minutes) from the start of an operation. Specifically, the outdoor control unit 173 determines the indoor air unit 20 having a highest temperature difference between a suction air temperature (a measured temperature of the temperature sensor 204) and a low-pressure two-phase refrigerant temperature (a detected temperature of the temperature sensor 203) as the indoor air unit 20 into which the refrigerant is flowing among the indoor air units 20.

Subsequently, the outdoor control unit 173 causes the outdoor storage unit 174 to store a setting (corresponding information) for associating the indoor air unit 20 and the branch port 52 for which the refrigerant inflow is determined (step S112, see FIG. 3).

Subsequently, the outdoor control unit 173 determines whether or not the determination of all the indoor air units 20 is completed (step S113). When the determination of all the indoor air units 20 is completed (step S113: YES), the outdoor control unit 173 moves the process to step S114. Also, the outdoor control unit 173 returns the process to step S110 when the determination of all the indoor air units 20 is not completed (step S113: NO).

In step S114, the outdoor control unit 173 changes corresponding relationships between the branch ports 52 and the indoor units (the indoor air unit 20-1, the indoor air unit 20-2, and the indoor hot water unit 30) on the basis of setting information (corresponding information) stored by the outdoor storage unit 174. The outdoor control unit 173 changes, for example, corresponding relationships between the indoor units (the indoor air unit 20-1, the indoor air unit 20-2, and the indoor hot water unit 30) and the pressure reduction mechanisms 13. For example, in the example of the connection shown in FIG. 5, the outdoor control unit 173 makes a setting change to a corresponding relationship for associating the indoor hot water unit 30 and the pressure reduction mechanism 13-1 and associating the indoor air unit 20-1 and the pressure reduction mechanism 13-3. After the processing of step S114, the outdoor control unit 173 ends a corresponding determination process (a connection determination process).

Also, in the process shown in FIG. 6, the processing of steps S102 to S107 corresponds to the indoor hot water unit-determination process (the processing of a first step) and the processing of steps S108 to S113 corresponds to the indoor air unit-determination process (the processing of a second step).

As described above, the multi-split type air-conditioning device 100 according to the present embodiment includes the indoor hot water unit 30 including the water circuit RC2 in which a water medium circulates as a heat exchange medium, the plurality of indoor air units 20 each including the indoor heat exchanger 21 (an air heat exchanger), and the outdoor unit 10 to which the indoor hot water unit 30 and the plurality of indoor air units 20 are connected. The outdoor unit 10 includes the branch ports 52 (52-1, 52-2, and 52-3), the wiring ports 71 (71-1, 71-2, and 71-3), and the outdoor unit-control unit 17. The branch ports 52 beside which the pressure reduction mechanisms 13 are disposed after a branch of the refrigerant circuit RC1 are connected to the plurality of indoor air units 20 and the indoor hot water unit 30 through pipes. The wiring ports 71 respectively correspond to the branch ports 52 and are connected to the indoor hot water unit 30 and the plurality of indoor air units 20 through transmission signal lines. The outdoor unit-control unit 17 controls the refrigerant circuit RC1 and transmits a control command for the indoor hot water unit 30 and the plurality of indoor air units 20 via transmission signal lines. Also, the outdoor unit-control unit 17 executes an indoor hot water unit-determination process and an indoor air unit-determination process. In the indoor hot water unit-determination process, the outdoor unit-control unit 17 causes the refrigerant circuit RC1 to perform a heating operation, causes a refrigerant to flow through the branch ports 52 sequentially using the pressure reduction mechanisms 13, and determines the branch port 52 to which the indoor hot water unit 30 is connected. In the indoor air unit-determination process after the indoor hot water unit-determination process is executed, the outdoor unit-control unit 17 causes the refrigerant circuit RC1 to perform a cooling operation, causes a refrigerant to flow through the branch ports 52 sequentially to which the indoor hot water unit 30 is not connected, and determines a connection relationship between the branch ports 52 to which the plurality of indoor air units 20 are connected and the plurality of indoor air units 20.

Thereby, the multi-split type air-conditioning device 100 according to the present embodiment determines the connection of the indoor hot water unit 30 in the indoor hot water unit-determination process and determines the connection of the indoor air unit 20 in the indoor air unit-determination process and hence can appropriately determine the connections between the outdoor unit 10 and the indoor units (the indoor hot water unit 30 and the indoor air unit 20) even if both the indoor hot water unit 30 and the indoor air unit 20 are included. The operator who installs the multi-split type air-conditioning device 100 does not need to determine the connection relationship of the indoor units (the indoor hot water unit 30 and the indoor air unit 20) in complicated manual work and the installation work time can be shortened.

Also, the multi-split type air-conditioning device 100 according to the present embodiment executes the indoor hot water unit-determination process before the indoor air unit-determination process is executed according to the cooling operation and hence the pressure reduction mechanism 13-3 connected to the indoor hot water unit 30 is open in the indoor air unit-determination process according to the cooling operation and the refrigerant-water heat exchanger 31 is not damaged by freezing when the cold refrigerant flows through the indoor hot water unit 30. Thus, the multi-split type air-conditioning device 100 according to the present embodiment can more safely determine the connections between the outdoor unit 10 and the indoor units (the indoor hot water unit 30 and the indoor air unit 20) and improve reliability thereof.

Also, in the present embodiment, the outdoor unit-control unit 17 changes a corresponding relationship between a control target indoor unit, which is the indoor hot water unit 30 or the indoor air unit 20, and the branch port 52 (or the pressure reduction mechanism 13) such that the control target indoor unit corresponds to the branch port 52 (or the pressure reduction mechanism 13) to which to which the control target indoor unit is connected on the basis of a determination result of the indoor hot water unit-determination process and a determination result of the indoor air unit-determination process.

For example, as shown in FIG. 5, the multi-split type air-conditioning device 100 according to the present embodiment can be used as it is by changing the corresponding relationship without changing the connection when there are erroneous connections between the outdoor unit 10 and the indoor units (the indoor air unit 20-1, the indoor air unit 20-2, and the indoor hot water unit 30). Consequently, the multi-split type air-conditioning device 100 according to the present embodiment can improve convenience in installation work.

Also, the multi-split type air-conditioning device 100 according to the present embodiment includes the outdoor storage unit 174 (a corresponding information storage unit) configured to store corresponding information in which indoor unit identification information for identifying the control target indoor unit and identification information of the branch port 52 for identifying the branch port 52 are associated. The outdoor unit-control unit 17 causes the outdoor storage unit 174 to store the corresponding information corresponding to the indoor hot water unit 30 on the basis of the determination result of the indoor hot water unit-determination process, causes the outdoor storage unit 174 to store the corresponding information corresponding to the indoor air unit 20 on the basis of the determination result of the indoor air unit-determination process, and transmits the control commands to the control target indoor unit on the basis of the corresponding information stored by the outdoor storage unit 174.

Thereby, the multi-split type air-conditioning device 100 according to the present embodiment can easily take measures using the outdoor storage unit 174 when there are erroneous connections between the outdoor unit 10 and the indoor units (the indoor hot water unit 30 and the indoor air unit 20).

Also, in the present embodiment, the water circuit RC2 includes the refrigerant-water heat exchanger 31. The outdoor unit-control unit 17 determines the branch port 52 to which the indoor hot water unit 30 is connected on the basis of a temperature of the water medium at an inlet of the refrigerant-water heat exchanger 31 and a temperature of the water medium at an outlet of the refrigerant-water heat exchanger 31 in the indoor hot water unit-determination process.

Thereby, the multi-split type air-conditioning device 100 according to the present embodiment can easily determine the branch port 52 to which the indoor hot water unit 30 is connected in a simple method using water temperature.

Also, in the present embodiment, when the indoor hot water unit-determination process is being executed, the outdoor unit-control unit 17 causes the water circuit RC2 to circulate water with a water amount smaller than a water amount when the water circuit RC2 is normally operated.

Thereby, a temperature difference between the inlet and the outlet of the refrigerant-water heat exchanger 31 becomes larger by lowering the water amount of water circulating in the water circuit RC2. Therefore, the multi-split type air-conditioning device 100 according to the present embodiment can accurately determine the branch port 52 to which the refrigerant-water heat exchanger 31 is connected while reducing an erroneous determination.

Also, in the present embodiment, the outdoor unit-control unit 17 causes the water circuit RC2 to be operated in the hot water supply action mode in the indoor hot water unit-determination process.

Thereby, the multi-split type air-conditioning device 100 according to the present embodiment can execute an indoor hot water unit-determination process more safely by performing an operation in a hot water supply action mode in which the operation is guaranteed even in a place with a high temperature during a summer period or the like when the operation of hot water heating is not guaranteed.

Also, in the present embodiment, the indoor air unit 20 includes the blower 22 configured to blow air with respect to the indoor heat exchanger 21. When the indoor hot water unit-determination process is being executed, the outdoor unit-control unit 17 causes the blower 22 to blow an air with an air volume smaller than an air volume when the indoor air unit 20 is normally operated.

Thereby, the multi-split type air-conditioning device 100 according to the present embodiment can reduce the influence of the indoor heat exchanger 21 when the indoor hot water unit-determination process is being executed by lowering the air volume of the air from the blower 22 when the indoor hot water unit-determination process is being executed. Consequently, the multi-split type air-conditioning device 100 according to the present embodiment can reduce an erroneous determination of the indoor hot water unit-determination process.

Also, in the present embodiment, the outdoor unit-control unit 17 determines a connection relationship between the branch ports 52 to which the plurality of indoor air units are connected and the plurality of indoor air units 20 on the basis of a temperature of intake air and a temperature of the refrigerant in the indoor heat exchanger 21 in the indoor air unit-determination process.

Thereby, the multi-split type air-conditioning device 100 according to the present embodiment can easily determine the connection relationship between the branch port 52 to which the indoor air unit 20 is connected and the indoor air unit 20 in a simple method using the temperature of the intake air and the temperature of the refrigerant in the indoor heat exchanger 21.

Also, in the present embodiment, when the indoor air unit-determination process is being executed, the outdoor unit-control unit 17 causes the water circuit RC2 to circulate water with a water amount larger than a water amount when the indoor hot water unit-determination process is being executed.

Thereby, the multi-split type air-conditioning device 100 according to the present embodiment causes the water circuit RC2 to perform a circulation process and therefore it is possible to avoid freezing when a cold refrigerant flows into the refrigerant-water heat exchanger 31 unintentionally and to improve the reliability during the execution of the indoor hot water unit-determination process.

Also, in the present embodiment, the outdoor unit-control unit 17 causes the display unit 43 to display information indicating the determination result of the indoor hot water unit-determination process and the determination result of the indoor air unit-determination process. For example, the outdoor unit-control unit 17 causes the display unit 43 to display a determination result indicating a normal connection, a determination result of an erroneous connection, and the like.

Thereby, in the multi-split type air-conditioning device 100 according to the present embodiment, the operator can easily ascertain connection relationships between the outdoor unit 10 and the indoor units (the indoor hot water unit 30 and the indoor air unit 20) according to the contents displayed by the display unit 43.

Also, in the present embodiment, the outdoor unit-control unit 17 starts executing the indoor hot water unit-determination process and the indoor air unit-determination process in response to a start request from the external controller 40.

Thereby, the multi-split type air-conditioning device 100 according to the present embodiment can more easily start the connection determination process for the outdoor unit 10 and the indoor units (the indoor hot water unit 30 and the indoor air unit 20) using the external controller 40.

Also, the connection determination method according to the present embodiment is a connection determination method of determining a connection of an indoor unit in the above-described multi-split type air-conditioning device 100 including a first step and a second step. In the first step, the outdoor unit-control unit 17 executes the determination process of the indoor hot water unit 30 of causing the refrigerant circuit RC1 to perform a heating operation, causing a refrigerant to flow through the branch ports 52 sequentially using the pressure reduction mechanisms 13, and determining the branch port 52 to which the indoor hot water unit 30 is connected. In the second step after the indoor hot water unit-determination process is executed, the outdoor unit-control unit 17 executes an indoor air unit-determination process of causing the refrigerant circuit RC1 to perform a cooling operation, causing a refrigerant to flow through the branch ports 52 to which the indoor hot water unit 30 is not connected sequentially, and determining a connection relationship between the branch ports 52 to which the indoor air units 20 are connected and the plurality of indoor air units 20.

Thereby, the connection determination method according to the present embodiment has effects similar to those of the multi-split type air-conditioning device 100 according to the above-described embodiment and it is possible to appropriately determine connections between the outdoor unit 10 and the indoor units (the indoor hot water unit 30 and the indoor air unit 20) even if both the indoor hot water unit 30 and the indoor air unit 20 are included.

Also, the present disclosure is not limited to the above-described embodiment and modifications can be made without departing from the scope of the present disclosure.

For example, an example in which the multi-split type air-conditioning device 100 includes two indoor air units 20 is described in the above-described embodiment. However, the present disclosure is not limited thereto and may include one indoor air unit 20 or three or more indoor air units 20.

Although an example in which the outdoor unit-control unit 17 changes the corresponding relationship between the control target indoor unit and the branch port 52 (or the pressure reduction mechanism 13) on the basis of the determination result of the indoor hot water unit-determination process and the determination result of the indoor air unit-determination process is described in the above-described embodiment, the present disclosure is not limited thereto. For example, the outdoor unit-control unit 17 may be configured to cause the display unit 43 to display information based on the determination result of the indoor hot water unit-determination process and the determination result of the indoor air unit-determination process without executing the process of changing the corresponding relationship.

Although an example in which the outdoor unit-control unit 17 starts the connection determination process on the basis of a start instruction of the external controller 40 is described in the above-described embodiment, the present disclosure is not limited thereto. The outdoor unit-control unit 17 may be configured to start the connection determination process on the basis of, for example, an operation of a start switch provided in the outdoor unit 10 or an operation of the remote controller of the indoor hot water unit 30 and the indoor air unit 20.

Although an example in which the outdoor unit-control unit 17 determines that a refrigerant is flowing through the indoor hot water unit 30 on the basis of the outlet water temperature and the inlet water temperature of the refrigerant-water heat exchanger 31 is described in the above-described embodiment, the present disclosure is not limited thereto. The outdoor unit-control unit 17 may determine, for example, that a refrigerant is flowing through the indoor hot water unit 30 on the basis of the water temperature of the hot water storage tank 35 (the measured temperature of the temperature sensor 212). In this case, the outdoor unit-control unit 17 may determine, for example, that the refrigerant is flowing through the indoor hot water unit 30 by measuring that the measured temperature of the temperature sensor 212 is raised by a prescribed temperature or higher (for example, 2° C. or higher).

Also, an example in which corresponding information is stored in the outdoor storage unit 174 is described as shown in FIG. 3 in the above-described embodiment, the present disclosure is not limited thereto. The corresponding information may be used in association with identification information for identifying the indoor unit and identification information for identifying the pressure reduction mechanism 13.

Although an example in which the outdoor unit-control unit 17 executes the indoor hot water unit-determination process in the hot water supply operation mode (hot water supply action mode) is described in the above-described embodiment, the present disclosure is not limited thereto. The outdoor unit-control unit 17 may be configured to execute the indoor hot water unit-determination process in the hot water heating operation mode instead of the hot water supply operation mode (hot water supply action mode).

Although an example in which the blower 22 is stopped during the connection determination operation of the indoor hot water unit 30 is described in the above-described embodiment, the present disclosure is not limited thereto and the notch of a fan speed of the blower 22 may be operated at a minimum. Thereby, the indoor air unit 20 can also condense the refrigerant and exchange heat, thus avoiding the risk of the refrigerant circuit RC1 becoming a high-pressure pressure overload. However, if the notch of the fan speed is set to be excessively high, an amount of stagnant refrigerant in the indoor heat exchanger 21 may increase and a normal hot water heating operation may not be possible, such that it is preferable to operate the notch of the fan speed of the blower 22 at a minimum or to stop it.

Also, in the above-described embodiment, the display unit 43 may be allowed to display that the connection determination process is completed when the connection determination process is started from the external controller 40. Thereby, the operator can immediately recognize the end of the determination process and the installation work can be shortened. Furthermore, when the corresponding determination result is displayed to the display unit 43, for example, by displaying that corresponding relationships of all branch ports are consistent or a branch port location where the corresponding relationship is inconsistent, the operator can be alerted at the time of the next installation work and the improvement of installation quality can be promoted.

Also, the above-described multi-split type air-conditioning device 100 includes an internal computer system. The above-described processing steps of the connection determination process are stored on a computer-readable recording medium in the form of a program, and the above-described process is performed by a computer reading and executing this program. Here, the computer-readable recording medium refers to a magnetic disk, a magneto-optical disk, a CD-ROM, a DVD-ROM, a semiconductor memory, or the like. Also, the computer program may be delivered to the computer through a communication circuit and the computer that receives the delivered computer program may execute the program.

The invention claimed is:

1. A multi-split type air-conditioning device comprising:

an indoor hot water unit including a water circuit in which a water medium circulates as a heat exchange medium;

an indoor air unit including an air heat exchanger; and an outdoor unit to which the indoor hot water unit and the indoor air unit are connected, wherein the outdoor unit includes:

branch ports beside which pressure reduction mechanisms are disposed after a branch of a refrigerant circuit and to which the indoor air unit and the indoor hot water unit are connected through pipes; and an outdoor unit-control unit configured to control the refrigerant circuit and transmit control commands for the indoor hot water unit and the indoor air unit via transmission signal lines, and wherein the outdoor unit-control unit executes an indoor hot water unit-determination process of causing the refrigerant circuit to perform a heating operation, and determining the branch port to which the indoor hot water unit is connected and an indoor air unit-determination process of causing the refrigerant circuit to perform a cooling operation, and determining a connection relationship between the branch port to which the indoor air unit is connected and the indoor air unit.

2. The multi-split type air-conditioning device according to claim 1, wherein the outdoor unit-control unit executes the indoor hot water unit-determination process of causing the refrigerant circuit to perform a heating operation, causing the refrigerant to flow through the branch ports sequentially using the pressure reduction mechanisms, and determining the branch port to which the indoor hot water unit is connected and, after the indoor hot water unit-determination process is executed, the indoor air unit-determination process of causing the refrigerant circuit to perform a cooling operation, causing the refrigerant to flow through the branch port to which the indoor hot water unit is not connected, and determining the connection relationship between the branch port to which the indoor air unit is connected and the indoor air unit, wherein the outdoor unit-control unit changes a corresponding relationship between a control target indoor unit, which is the indoor hot water unit or the indoor air unit, and the branch port such that the control target indoor unit corresponds to the branch port to which the control target indoor unit is connected on the basis of a determination result of the indoor hot water unit-determination process and a determination result of the indoor air unit-determination process.

3. The multi-split type air-conditioning device according to claim 2, further comprising:

a corresponding information storage unit configured to store corresponding information in which indoor unit identification information for identifying the control target indoor unit and branch port identification information for identifying the branch port are associated, wherein the outdoor unit-control unit causes the corresponding information storage unit to store the corresponding information corresponding to the indoor hot water unit on the basis of the determination result of the indoor hot water unit-determination process, causes the corresponding information storage unit to store the corresponding information corresponding to the indoor air unit on the basis of the determination result of the indoor air unit-determination process, and transmits the control commands to the control target indoor unit on the basis of the corresponding information stored by the corresponding information storage unit.

4. The multi-split type air-conditioning device according to claim 1, wherein the water circuit includes a refrigerant-water heat exchanger, and wherein the outdoor unit-control unit determines the branch port to which the indoor hot water unit is connected on the basis of a temperature of the water medium at an inlet of the refrigerant-water heat exchanger and a temperature of the water medium at an outlet of the refrigerant-water heat exchanger in the indoor hot water unit-determination process.

5. The multi-split type air-conditioning device according to claim 4, wherein, when the indoor hot water unit-determination process is being executed, the outdoor control unit causes the water circuit to circulate water with a water amount smaller than a water amount when the water circuit is normally operated.

6. The multi-split type air-conditioning device according to claim 1, wherein the outdoor unit-control unit causes the water circuit to be operated in a hot water supply action mode in the indoor hot water unit-determination process.

7. The multi-split type air-conditioning device according to claim 1, wherein the indoor air unit includes a blower configured to blow air to the air heat exchanger, and wherein, when the indoor hot water unit-determination process is being executed, the outdoor unit-control unit causes the blower to blow an air with an air volume smaller than an air volume when the indoor air unit is normally operated.

8. The multi-split type air-conditioning device according to claim 1, wherein the outdoor unit-control unit determines the connection relationship between the branch ports to which the plurality of indoor air units are connected and the indoor air unit on the basis of a temperature of intake air and a temperature of the refrigerant in the air heat exchanger in the indoor air unit-determination process.

9. The multi-split type air-conditioning device according to claim 1, wherein, when the indoor air unit-determination process is being executed, the outdoor unit-control unit causes the water circuit to circulate water with a water amount larger than a water amount when the indoor hot water unit-determination process is being executed.

10. The multi-split type air-conditioning device according to claim 1, wherein the outdoor unit-control unit causes a display unit to display information indicating a determination result of the indoor hot water unit-determination process and a determination result of the indoor air unit-determination process.

11. The multi-split type air-conditioning device according to claim 1, wherein the outdoor unit-control unit starts executing the indoor hot water unit-determination process and the indoor air unit-determination process in response to a start request from an external controller.

12. A connection determination method of determining a connection of an indoor unit in a multi-split type air-conditioning device including an indoor hot water unit including a water circuit in which a water medium circulates as a heat exchange medium, a plurality of indoor air units each including an air heat exchanger, and an outdoor unit to which the indoor hot water unit and the plurality of indoor air units are connected, wherein the outdoor unit includes:

branch ports beside which pressure reduction mechanisms are disposed after a branch of a refrigerant circuit and to which the plurality of indoor air units and the indoor hot water unit are connected through pipes; and an outdoor unit-control unit configured to control the refrigerant circuit and transmit control commands for the indoor hot water unit and the plurality of indoor air units via transmission signal lines, wherein the outdoor unit-control unit executes an indoor hot water unit-determination process of causing the refrigerant circuit to perform a heating operation, causing a refrigerant to flow through the branch ports sequentially using the pressure reduction mechanisms, and determining the branch port to which the indoor hot water unit is connected, and wherein, after the indoor hot water unit-determination process is executed, the outdoor unit-control unit executes an indoor air unit-determination process of causing the refrigerant circuit to perform a cooling operation, causing the refrigerant to flow through the branch ports to which the indoor hot water unit is not connected, and determining a connection relationship between the branch ports to which the plurality of indoor air units are connected and the plurality of indoor air units.

* * * * *